United States Patent [19]

Trigourea

[11] Patent Number: 4,501,193

[45] Date of Patent: Feb. 26, 1985

[54] MOUNTING CURB FOR MULTIPLE UNIT AIR CONDITIONING SYSTEM

[75] Inventor: Spiridon Trigourea, Palatin Township, Cook County, Ill.

[73] Assignee: Snyder General Corporation, Dallas, Tex.

[21] Appl. No.: 445,149

[22] Filed: Nov. 29, 1982

[51] Int. Cl.[3] ..... F24F 5/00

[52] U.S. Cl. ..... 98/33.1; 62/259.1; 62/DIG. 16; 98/35

[58] Field of Search ..... 62/259.1, DIG. 16; 98/33 R, 35, 116, 114; 165/139, 143; 138/39

[56] References Cited

U.S. PATENT DOCUMENTS

| | | | |
|---|---|---|---|
| 2,344,706 | 3/1944 | Kucher | 62/DIG. 16 |
| 2,662,553 | 12/1953 | Dimmock | 138/39 X |
| 2,896,428 | 7/1954 | Paton | 62/DIG. 16 |
| 3,020,822 | 2/1962 | Hopkinson et al. | 98/121 |
| 3,721,106 | 3/1973 | Bierwirth et al. | 62/259.1 X |
| 3,729,950 | 5/1979 | Astrom | 62/259 |
| 3,831,395 | 8/1974 | Levy | 62/263 |
| 4,118,083 | 10/1978 | Lackey et al. | 312/100 |
| 4,139,052 | 2/1979 | Lackey | 165/59 |
| 4,149,590 | 4/1974 | Ospelt | 62/DIG. 16 X |
| 4,315,415 | 2/1982 | Wilson | 62/263 |
| 4,362,091 | 12/1982 | Cox | 98/116 |
| 4,403,481 | 9/1983 | Yoho, Jr. | 62/DIG. 16 X |

FOREIGN PATENT DOCUMENTS

| | | | |
|---|---|---|---|
| 766015 | 8/1967 | Canada | 62/259.1 |

*Primary Examiner*—Harold Joyce

*Attorney, Agent, or Firm*—Hubbard, Thurman, Turner & Tucker

[57] ABSTRACT

A mounting curb for rooftop packaged air conditioning units comprising a generally rectangular frame having a bottom wall with adjacent return and supply air duct openings formed therein and in communication with respective common supply and return air ducts formed in the curb. The return air duct includes opposed branch portions leading to openings in the top wall of the curb in communication with the return air openings in the air conditioning units. The supply air duct includes opposed branch portions also in communication with respective supply air openings in the bottom wall of the air conditioning unit enclosures. The supply air duct is disposed generally over the return air duct and inward therefrom with respect to the opposite end walls of the curb.

18 Claims, 10 Drawing Figures

MOUNTING CURB FOR MULTIPLE UNIT AIR CONDITIONING SYSTEM

BACKGROUND OF THE INVENTION

1. Field of the Invention

The present invention pertains to a mounting frame or curb for at least two packaged air conditioning units and which includes combined return air and supply air plenums for conducting air through one or both of the air conditioning units which are connected to common building return and supply air ducts through the curb.

2. Background

The development of packaged air conditioning units for commercial building applications has been well accepted, particularly, in regard to units which are adapted for mounting on building rooftops and other horizontal surfaces. So-called packaged air conditioning units typically include circulating fans, air cooling and heating heat exchangers or elements, and filters, all mounted within a cabinet or enclosure and usually having air inlet and discharge openings formed in the bottom wall thereof. These packaged units are typically mounted on a subframe supported by the building roof or other structure and common return and supply air ducting for the building air circulating system is connected to the return air and supply air openings in the enclosures.

However, the demand for ever increasing capacity of packaged commercial air conditioning systems and the desire for reliability in such systems has made it desirable to consider systems of multiple air conditioning units mounted in a generally clustered arrangement to facilitate the design of air ducting, power supply and control wiring and other requirements of the systems. In this regard the desire for clustered arrangements of multiple air conditioning units has resulted in the development of the present invention which solves the problem of providing a suitable mounting structure for multiple side-by-side units while at the same time providing return air and supply air ducting for conducting the recirculating conditioned air from the building, through the air conditioning units and back into the building air circulation system.

SUMMARY OF THE INVENTION

Accordingly, the present invention is directed to a unique support frame or curb particularly adapted for supporting multiple packaged type air conditioning units and for connecting the return air and supply air duct systems of the building air network to one or both of the air conditioning units mounted on the frame.

In accordance with one aspect of the present invention there is provided a common support frame or curb for at least two packaged air conditioning units wherein each of the self contained, cabinet enclosed air conditioning units may be mounted on a common frame and may be connected to a common building supply air duct for circulating conditioned air to the building air duct network through unique supply air ducting built into the mounting curb.

In one embodiment of the invention the combined mounting curb and air plenum or duct arrangement provides for connection of multiple packaged air conditioning units to a common return air duct and a common supply air duct for the building air circulation system. In accordance with another embodiment of the invention the curb is mounted on an improved arrangement of a system for minimizing the transmission of mechanical vibrations to the structure supporting the curb. In accordance with still another embodiment of the present invention separate return air or supply air ducts may be connected to the respective air conditioning units mounted on the curb and a common duct is provided for the other of either the return air or supply air ducts of the building air circulation system.

Several advantages of the present invention will be apparent to those skilled in the art. The unique curb structure is adapted to be fabricated in at least two separate sections to facilitate installation on building roof tops and other elevated structures. The arrangement of mounting a plurality of packaged air conditioning units on a single support frame or curb having ducting adapted to be connected to the main return air and supply air ducts for the building air circulation system permits the use of a plurality of smaller capacity air conditioning units. Moreover, in accordance with two embodiments of the invention, two separate air conditioning units are in circuit with a common return and supply air circulation system in such a way as to permit operation of one or both air conditioning units, as desired, whereby one unit may be operated as the regular duty unit and the other as a standby unit, or one unit may be cycled on and off in accordance with building air conditioning load requirements.

The improved arrangement of the curb structure for distributing return air to the air inlet openings of each of a plurality of air conditioning units, and for conducting the supply air from the air discharge openings of each of the air conditioning units, as well as other advantages provided by the curb structure, will be further appreciated upon reading the detailed description which follows in conjunction with the drawings.

DESCRIPTION OF THE PREFERRED EMBODIMENTS

Figure 1:
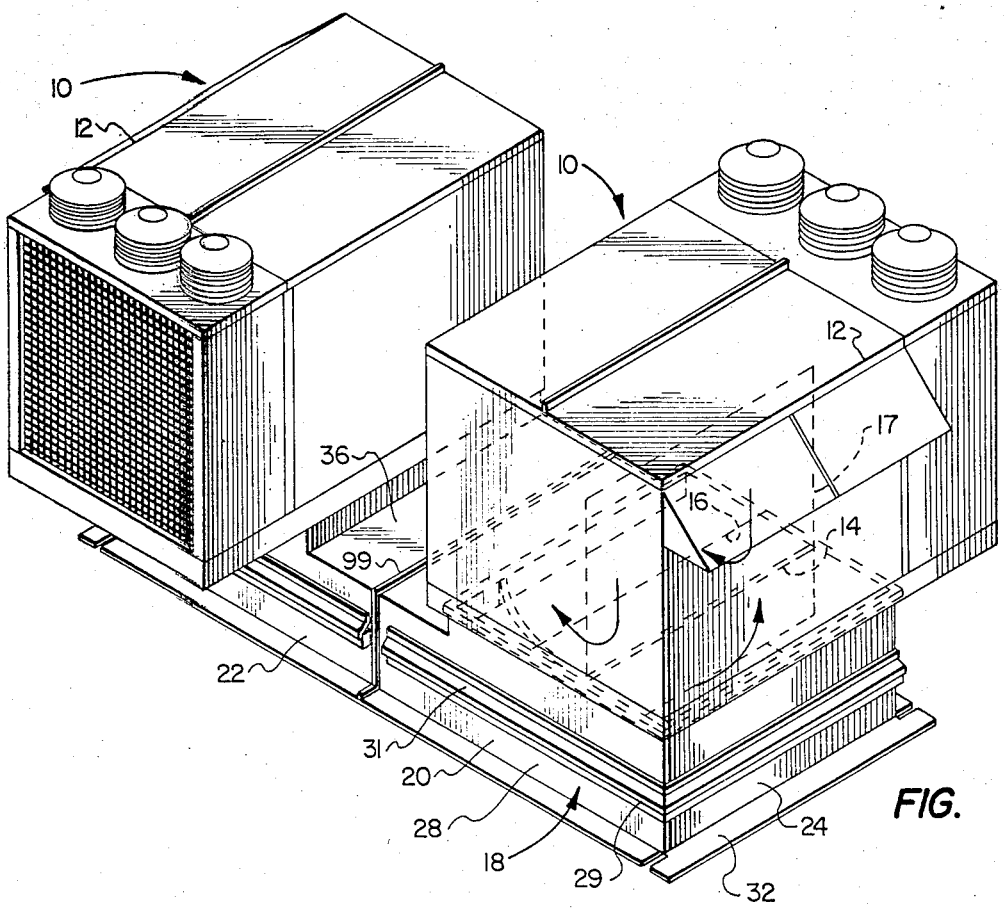
FIG. 1 is a perspective view of a mounting curb for two separate packaged type air conditioning units in accordance with the present invention.

In the description which follows like parts are marked throughout the specification and drawings with the same reference numerals, respectively. Certain structural features are not necessarily illustrated to scale in the drawings in the interest of clarity. The terms supply and return air are used for convenience only and it will be appreciated by those skilled in the art that the curbs may be modified so that the direction of flow of air through the duct sections of the curbs may be reversed while utilizing at least some of the unique features of the invention.

Referring to FIG. 1, there is illustrated a perspective view showing two self contained packaged type air conditioning units, each generally designated by the numeral 10. The air conditioning units 10 are of a type which are adapted for so-called rooftop mounting and are substantially self contained. The air conditioning units 10 each include generally rectangular boxlike enclosures or cabinets 12 in which are mounted air propelling fans, filter units, and heat exchanger apparatus for heating and/or cooling air supplied to the units through the mounting curb and ducting arrangement of the present invention.

Figure 4:
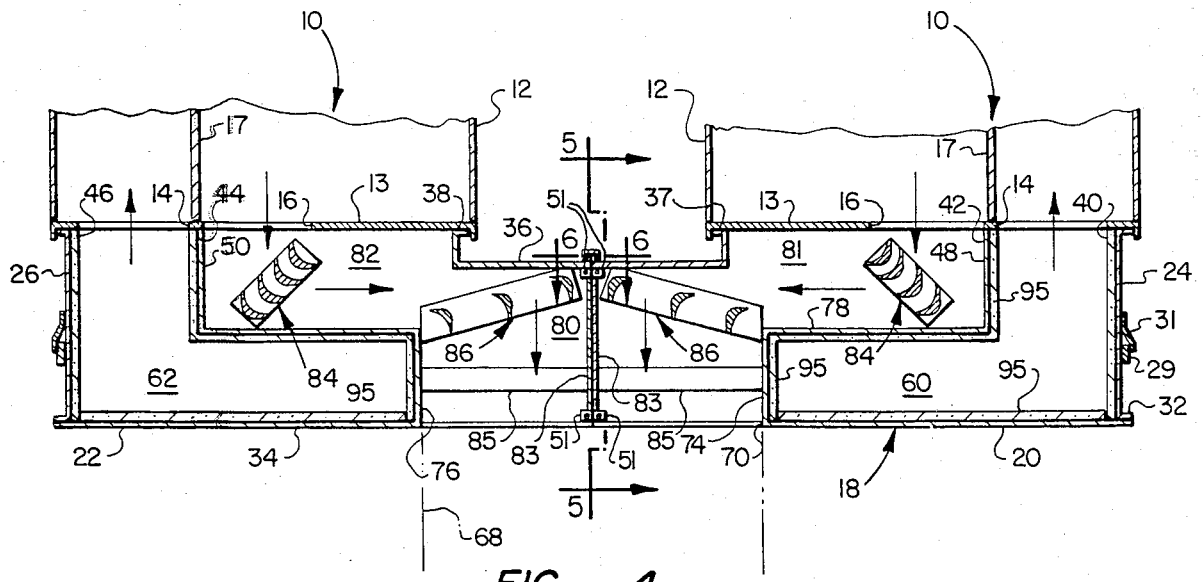
FIG. 4 is a section view taken along the line 4—4 of FIG. 2.

The enclosures 12 are adapted to have respective air inlet or return air openings formed in their bottom walls 13, which openings are designated by the numeral 14 in FIGS. 1 and 4. The enclosures 12 also include spaced apart and separate air discharge or supply air openings 16 also formed in the bottom walls 13. The openings 14 and 16 are separated by internal partitioning or the like, as indicated by the numeral 17 in FIGS. 1 and 4 and which may include suitable ducting for conducting the air entering the enclosures 12 through filter media, heat exchanger units, propulsion fans and the like before the air is discharged from the enclosures through the discharge or supply air openings 16. Those skilled in the art will appreciate that various arrangements of the air conditioning units 10 may be provided in accordance with utilizing the mounting curb of the present invention; however, a representative type of air conditioning unit which is particularly adapted for use with the mounting curb is a model R-250 packaged rooftop air conditioning system manufactured by Climate Control Unit of Snyder General Corporation, Red Bud, Ill.

Figure 2:
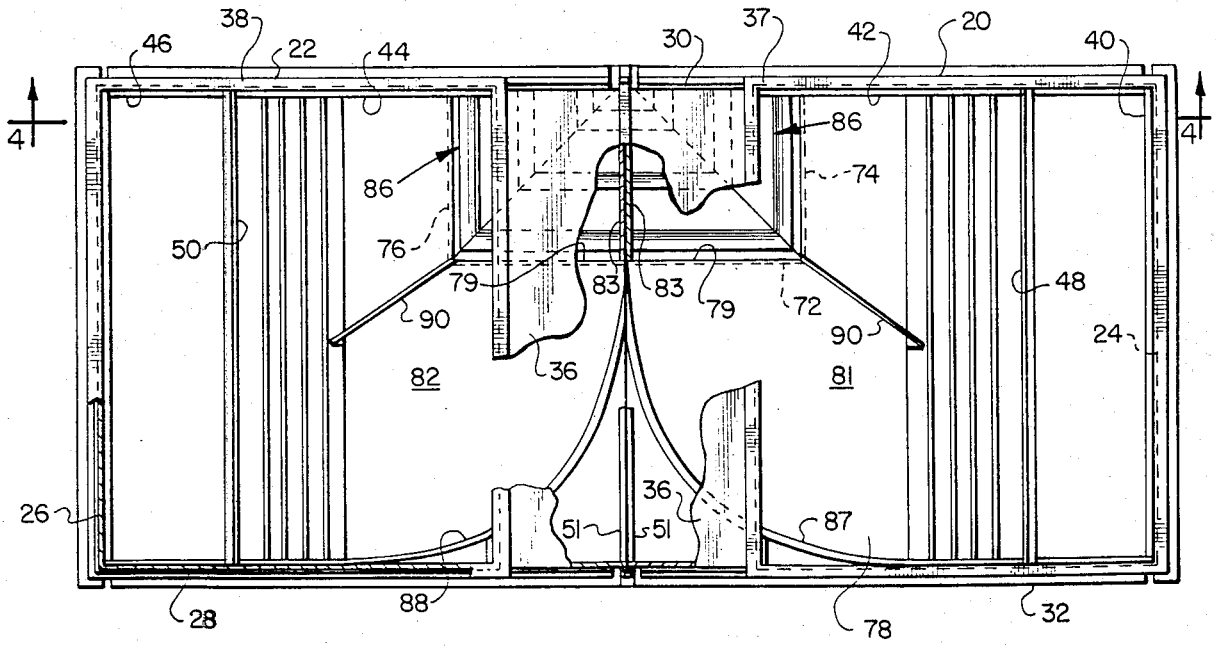
FIG. 2 is a top plan view of the mounting curb illustrated in FIG. 1 with the air conditioning units removed.
Figure 5:
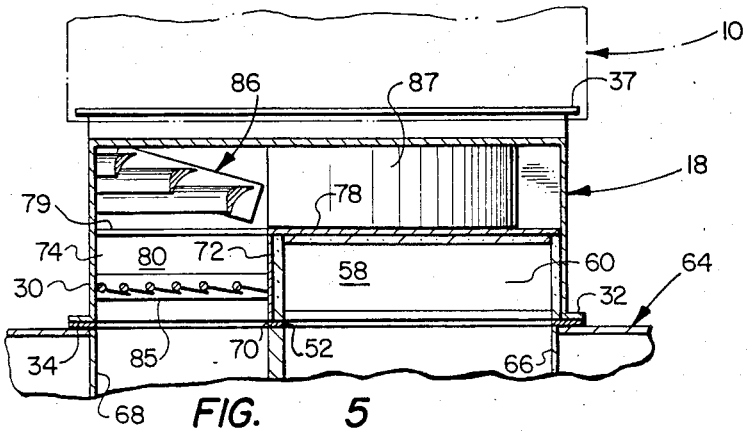
FIG. 5 is a section view taken generally along the line 5—5 of FIG. 4.

Referring further to FIGS. 1, 2 and 4, the mounting curb of the present invention is generally designated by the numeral 18 and includes a generally rectangular frame which is preferably formed in two modules or sections 20 and 22 for the convenience of handling the mounting curb in transportation and placement at the final site. The curb 18 may, of course, also be formed as a single unitary structure and will be discussed generally in that context with respect to describing its sidewalls and top and bottom walls in the interest of clarity and conciseness. The mounting curb 18 includes opposed end walls 24 and 26 and longitudinal parallel sidewalls 28 and 30. A conventional perimeter wood nailer 29 extends around the outside of the aformentioned walls and is covered by a flashing 31. The side and end walls are preferably formed to have a horizontally extending perimeter flange 32 which is adapted for supporting the mounting curb on a roof structure, a portion of which is shown in FIG. 5. The mounting curb 18 also includes a bottom wall 34 and a top wall portion 36 disposed between opposed upwardly facing rectangular perimeter flanges 37 and 38. Portions of the flanges 37 and 38 and a portion of the top wall 36 are broken away in FIG. 2 for illustrative purposes. The flanges 37 and 38 define a further portion of the top wall of the mounting curb and also define, in part, spaced apart openings 40, 42, 44 and 46, respectively. The openings 40 and 42 are separated by a vertical intermediate wall 48 parallel to the end wall 24, and the openings 44 and 46 are separated in like manner by a vertical intermediate wall 50 extending parallel to the end wall 26.

Figure 3:
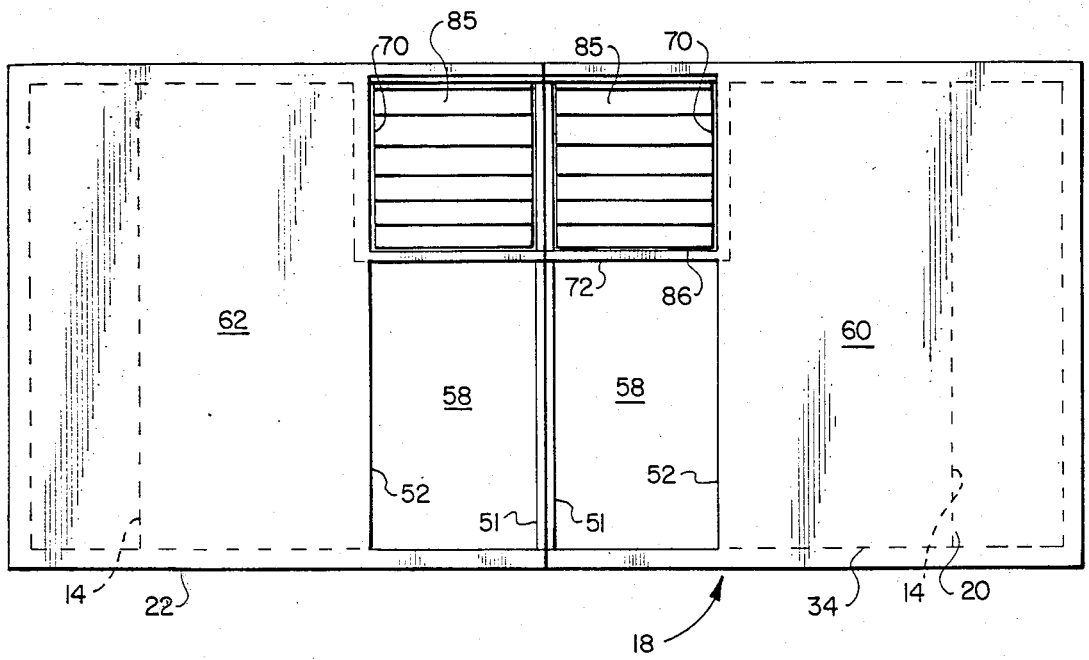
FIG. 3 is a bottom plan view of the mounting curb.

The curb 18 further includes upper and lower transverse brace members 51 extending across the contiguous edges of the sections 20 and 22. As shown in FIG. 3, air inlet openings 52 are formed in the bottom wall 34 and are adapted to be in communication with the openings 40 and 46 by a common return air duct, generally designated by the numeral 58. The duct 58 includes opposed branch portions 60 and 62, FIG. 4, which are in communication with the respective duct openings 40 and 46.

In accordance with one preferred arrangement of the invention, the curb 18 is mounted on a roof structure, generally designated by the numeral 64 in FIG. 5, and is placed over a building return air duct 66 whereby the openings 52 and the duct 58 are in communication with the building return air duct. The particular arrangement illustrated for the mounting of the curb 18, as illustrated in FIG. 5, also includes a supply air duct 68 also opening through the horizontal surface of the roof 64 and adapted to be in communication with second openings 70 in the bottom wall 34 and which are separated from the openings 52 by an intermediate vertical longitudinal wall portion 72. The wall portion 72 extends to opposed parallel transverse sidewall portions 74 and 76, see FIGS. 2, 4 and 5, which are contiguous with the sidewall 30 and with the intermediate wall portion 72. The curb 18 also includes a generally horizontally extending wall 78 parallel to the bottom wall 34 and which has an opening 79 therein which opening is delimited by the intermediate wall portion 72, the intermediate transverse walls 74 and 76 and a portion of the outside sidewall 30. The opening 79 is formed in a duct, generally designated by the numeral 80, which is in communication with the building supply air duct 68 through the bottom wall openings 70 and includes opposed branch portions 81 and 82, as shown in FIG. 4. The supply air duct branch portions 81 and 82 are in communication with the respective openings 16 in the enclosures 12.

The branch portion 81 of the duct 80 includes a first set of air turning louvers or vanes, generally designated by the numeral 84, which are arranged to redirect air flowing through the openings 16 and 42 into the branch portion 81 from a generally vertical direction to a horizontal direction. In like manner, the duct branch portion 82 includes a similar set of air turning vanes 84 for redirecting air flowing through the openings 16 and 44 from a vertical direction to a generally horizontal direction and toward the opening 79. The duct branch portions 81 and 82 each further include a set of air turning vanes or louvers formed in a generally L-shaped pattern, as illustrated in FIG. 2 and designated by the numeral 86, and which are adapted to turn the air flow from a generally horizontal direction when flowing through the duct branch portions 81 and 82, respectively, to a vertical direction for flow through the openings 79 and 70 and into the building supply air duct 68.

Referring particularly to FIG. 2, each of the branch portions 81 and 82 of the supply air duct 80 include respective curved wall sections 87 and 88 which curve away from the sidewall 28 toward the opening 79 for turning air flow in a direction toward the turning louvers 86. Each of the duct branch portions 81 and 82 also includes a somewhat diagonally extending flow splitter wall portion 90 extending from the respective sets of turning louvers 84 to the corners of opening 79 formed by the intersections of the respective transverse wall portions 74 and 76 with the intermediate longitudinal wall 72 as shown in FIG. 2. The flow splitter walls 90 are adapted primarily for providing an even distribution of flow through the rectangular arrangement of turning louvers 86.

In a preferred arrangement of the curb 18 the duct branch portions 81 and 82 are separated from each other by adjacent vertical walls 83. The walls 83, which may be formed as a single thickness and on only one of the sections 20 or 22, extend vertically between the walls 34 and 36 and horizontally only between the sidewall 30 and the intermediate wall 72 thereby leaving the branch portions 60 and 62 of the return air duct 58 in communication with each other within the curb itself. The vertical portions of the duct branches 81 and 82, opening to the bottom wall 34, each contain a backdraft damper unit 85 which permits only downward unidirectional flow of air out of the duct branches 81 or 82 into the building supply duct 68. The dampers 85 may be of a type commercially available and comprising a set of hinged louvers which are spring or weight biased in the closed position. Accordingly, thanks to the provision of the backdraft dampers 85 one or the other of the air conditioning units 10 may be operated alone without discharging conditioned air in a reverse flow path through the idled unit. The walls 83 could be eliminated if there was no requirement to provide the backdraft dampers 85.

The mounting curb 18 is provided with a unique arrangement of return air and supply air plenums or ducts as previously described contained wholly within the curb for conducting return air to the air conditioning units 10 from a building common return air duct such as the duct 66 and for discharging conditioned air to the building supply air duct 68. Air returning from the building return air duct 66 enters the mounting curb through the bottom wall openings 52 and flows into the common return air duct 58 wherein the flow is then split and flows through the branch portions 60 and 62 and out of the curb through the respective openings 40 and 46 into the respective air conditioning units 10. Conditioned air discharged from the units 10 flows through the respective bottom wall discharge openings 16 into the supply air duct branch portions 81 and 82 and is guided by the turning louvers 84, the respective curved sidewalls 87 and 88 and the flow splitter walls 90 towards the turning louver assemblies 86. The air flow is redirected from a horizontal to a generally vertical direction downward through the intermediate wall openings 79, the backdraft dampers 85 and the bottom wall openings 70 and into the building supply air system through duct 68.

Figure 6:
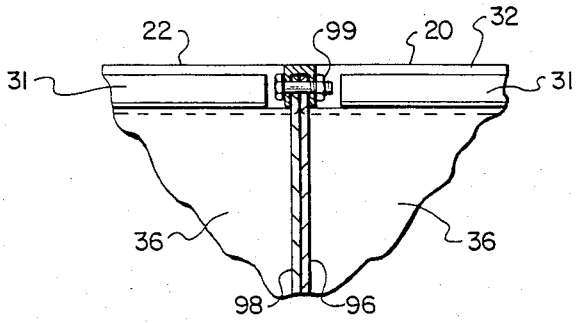
FIG. 6 is a detail section view taken along the line 6—6 of FIG. 4, and illustrating an arrangement for connecting the opposed sections of the mounting curb together.

The ducts 58 and 80 may be lined with a suitable sound and/or heat insulation material as illustrated in the drawing figures and generally designated by the numeral 95. The structural and duct defining walls of the curb 18 may be formed of conventional engineering metals such as steel or aluminum of a prescribed thickness sufficient to form a substantially rigid structure capable of supporting the weight of the air conditioning units 10. The various sidewalls, end walls and intermediate walls may be joined by welding or other suitable fastening techniques. As previously mentioned, it is convenient to form the curb 18 in separate sections 20 and 22 which are adapted to be joined together along opposed complementary flanges 96 and 98, FIG. 6, which extend parallel to the end walls 24 and 26 and are opposite these walls, respectively. The flanges 96 and 98 may be secured in assembly to form the curb as a unitary structure by a channel shaped cap 99, as illustrated in FIG. 6. The cap may be secured to the flanges 96 and 98 by conventional fastening techniques including rivets and/or threaded bolts. Accordingly, the mounting curb 18 may be more easily handled for being hoisted into place on a rooftop, for example, by handling the separate sections 20 and 22 and assembling the curb into a unitary structure on final placement in the desired location on the building structure.

Figure 7:
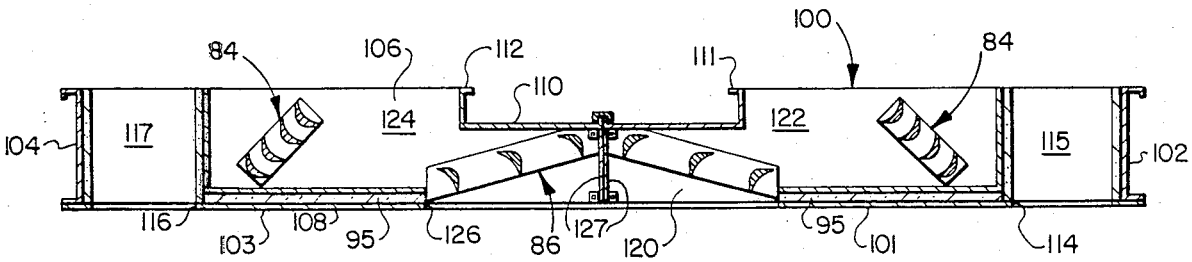
FIG. 7 is a longitudinal section view of an alternate embodiment of the mounting curb wherein separate return air ducts are connected to the respective air conditioning units.

Those skilled in the art will appreciate from the foregoing description that a particularly unique mounting curb for rooftop type air conditioning units is provided in accordance with the embodiment of the invention disclosed in conjunction with FIGS. 1 through 6. A similar and equally unique curb is illustrated in conjunction with FIG. 7 of the drawings. Referring to FIG. 7 there is illustrated a side elevation, in section, of a mounting curb for rooftop air conditioning units, and generally designated by the numeral 100. The section view of FIG. 7 is taken in the same relative position with respect to the curb 100 as the section view of FIG. 4 with respect to the curb 18. The mounting curb 100, which is similar to the curb 18 in many respects but is referred to a single tiered curb, is provided with opposed end walls 102 and 104 and spaced apart sidewalls 106, one shown in FIG. 7. The curb 100 includes a bottom wall 108 and a top wall 110 including spaced apart and vertically elevated flanges 111 and 112 for supporting the air conditioning units 10 in a manner similar to the arrangement for the mounting curb 18. The bottom wall 108 includes spaced apart return air openings 114 and 116 which are in communication with separate return air ducts 115 and 117, respectively. The curb 100 includes a common supply air duct 120 having opposed branch portions 122 and 124 also provided with the respective sets of air turning louvers 84 and 86. However, the supply air duct opening 126 formed in the bottom wall 108 may extend the full transverse width of the curb 100, if desired, since the return air ducts are not disposed under the supply air duct branch portions 122 and 124 and the associated building air ducts are not required to be placed directly adjacent to each other as in the arrangement shown in FIG. 5. The curb 100 is also preferably formed in separate sections 101 and 103 which, if provided wherein the opening 126 extends the full width of the curb, may actually be identical sections.

In the arrangement of the curb 100 suitable backdraft dampers could be interposed in the branch portions 122 and 124 to provide for operation of one or the other of the air conditioning units 10 as the base load unit with the other unit acting as a standby or peak load unit. In the arrangement as described above wherein the width of the opening 126 extends the full width of the curb 100 a set of turning vanes or louvers such as the set 84 would be used in place of the generally rectangular configuration of the sets of turning louvers 86 for turning the air from the horizontal direction to the vertical direction before flowing out of the opening 126. The curb 100 may also include a transverse wall 127 for separating the duct branch portions 122 and 124. The curb 100 may, of course, also be constructed of materials and using fabrication techniques similar to those for constructing the curb 18. Moreover, the supply and/or return air duct portions formed in the curb 100 may also be provided with a suitable liner of insulating material 95, as illustrated.

Figure 8:
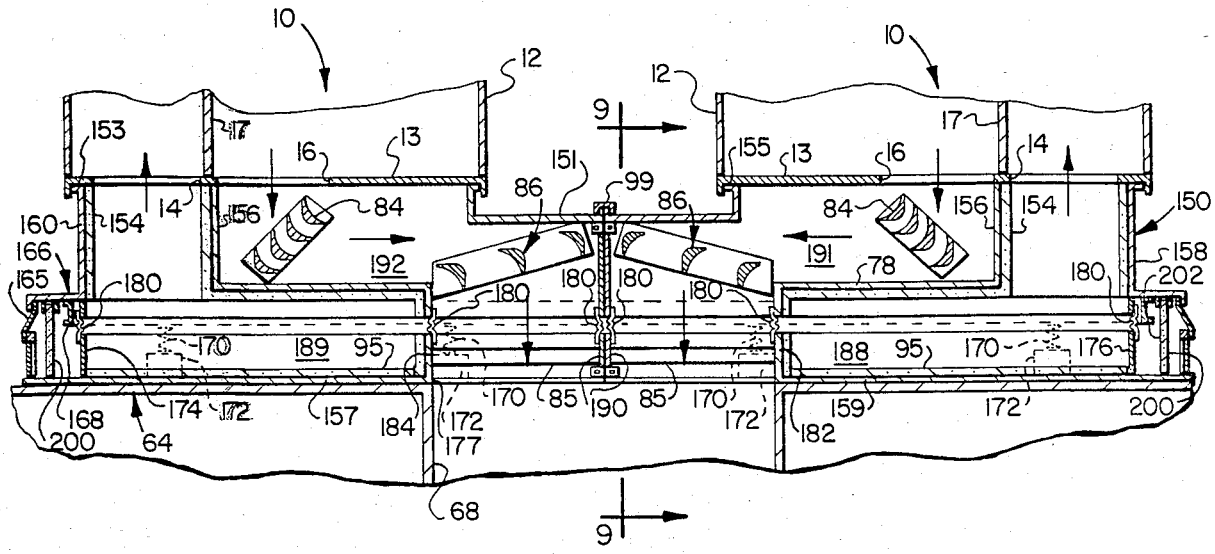
FIG. 8 is a longitudinal side section view similar to FIG. 4 and illustrating another embodiment of the present invention.
Figure 10:
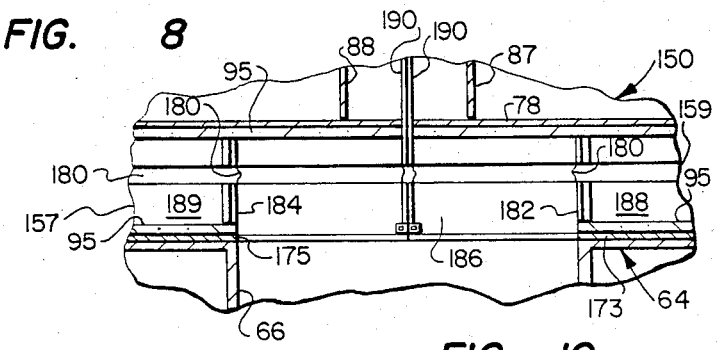
FIG. 10 is a detail section view taken along line 10—10 of FIG. 9.
Figure 9:
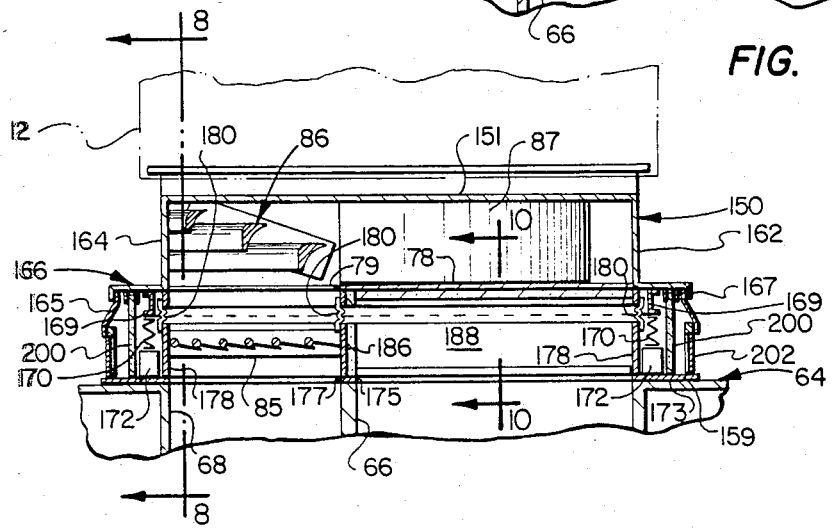
FIG. 9 is a section view taken along line 9—9 of FIG. 8.

Another embodiment of the mounting curb of the present invention is illustrated in FIGS. 8 and 9 of the drawings and is generally designated by the numeral 150. The curb 150 includes a top wall 151 and spaced apart support flanges 153 and 155 having respective sets of openings 154 and 156 in communication in communication with the respective openings 14 and 16 of the units 10 substantially like the curb 18. The curb 150 is similar in some other respects to the curb 18 but is particularly adapted to provide for isolating vibration generated by the air conditioning units 10 from the roof structure on which the curb is mounted. A portion of the roof structure 64 is illustrated in FIGS. 8 and 9. The curb 150, like the curb 18, is formed in two substantially mirror image modules or sections 157 and 159 and includes opposed end walls 158 and 160, and longitudinal sidewalls 162 and 164. The side and end walls of the curb 150 are formed with a lower laterally projecting perimeter flange, generally designated by the numeral 166, which is formed approximately intermediate the upper and lower faces of the curb 150, as compared with the curb 18 and is provided with a perimeter supporting member 168 which may comprise a fabricated steel channel type section, for example. As shown by way of example in FIG. 9, the longitudinal sidewall portions of the channel 168, which are designated by the numerals 169, are supported on spaced apart resilient isolator mounting springs 170 which are each mounted on a suitable pedestal structure 172. The pedestals 172 are supported on the longitudinal peripheral sides of the curb bottom wall 173. The isolator springs 170 are arranged preferably suitably spaced apart along the opposite longitudinal sides of the curb, as shown by way of example in FIG. 8. The curb 150 includes respective openings 175 and 177, FIG. 9, in the bottom wall 173 which are in communication, respectively, with return air duct branches 188 and 189, see FIG. 10, and with respective supply air duct branch portions 191 and 192.

The lower vertical walls of the curb 150, defining portions of the return air ducts and the supply air ducts are preferably formed by sheet metal sections 174, 176 and 178 which are connected to the upper end and sidewalls, respectively, and each include a flexible fabric connector band portion generally designated by the numeral 180. The connector portion 180 may comprise a continuous band of fabric or other flexible material which interconnects the upper sidewalls and end walls of the curb with the lower side and end wall sections. Moreover, intermediate transverse walls 182, 184 and 190, FIG. 8, and an intermediate longitudinal wall portion 186, FIG. 9, defining portions of the supply air ducts 191 and 192, are also provided with a fabriclike flexible connector band portion 180.

The backdraft damper assemblies 85 are mounted in the lower portions of the respective supply air duct branch portions, below the air turning louver assemblies 86, as shown.

The lower outside perimeter wall sections may be provided with an insulating liner or, as illustrated, a flexible perimeter insulation layer 200 is provided around the exterior of the curb and is suitably shielded by an outer vertical curb wall 202. The insulation layer 200 is preferably a flexible structure such as a fiberglass bat or panel which is secured along its upper edge to the flange 166 and is supported at its lower edge by the peripheral edges of the bottom wall 173. The flange 166 has a vertical coaming portion 167 to which is secured to a flashing 165 extending over the outside of the curb wall 202, as illustrated. Accordingly, the curb 150 is provided with the unique arrangement of supply and return air ducting similar to the curb 18 but is adapted to be flexibly mounted on the roof 152 to substantially isolate the air conditioning units supported by the curb from the roof structure.

Those skilled in the art will recognize that the mounting curbs described herein may be subject to various modifications and alterations without departing from the scope and spirit of the invention as recited in the appended claims.

What is claimed is:

1. A mounting curb for supporting at least two self contained air conditioning units adapted for roof top installation, said air conditioning units each including an enclosure having a bottom wall including a first opening for receiving return air from a building return air duct and a second opening for discharging conditioned air to a building supply air duct, said mounting curb being characterized by:

a rectangular perimeter frame including spaced apart longitudinal sidewalls and opposed end walls;

means on said frame for supporting each of said enclosures spaced apart on said frame;

spaced apart generally horizontal top wall means and bottom wall means of said frame joined to said side walls and said end walls, respectively;

a set of spaced apart first openings in said top wall means adapted to be aligned with respective ones of said first openings in said enclosures;

a set of spaced apart second openings in said top wall means adapted to be aligned with respective ones of said second openings in said enclosures;

first and second openings formed in said bottom wall means adjacent to each other generally centrally disposed between said end walls and in communication with said building air ducts, respectively;

a first set of opposed ducts formed in said curb for conducting air between said first openings in said top wall means and said first opening in said bottom wall means, respectively;

a second set of opposed ducts formed in said curb for conducting air between said second openings in said top wall means and said second opening in said bottom wall means, respectively; and respective horizontal wall means and vertical wall means in said curb each forming common walls separating each of said first ducts from each of said second ducts for directing air between said enclosures and said building air ducts within said frame.

2. The mounting curb set forth in claim 1 wherein:

said first and second openings in said bottom wall means are formed between said first set of openings in said top wall means.

3. The mounting curb set forth in claim 1 including:

a first set of air flow directing louvers disposed in each of said first ducts for guiding air flow from a vertical direction to a horizontal direction within said first ducts, respectively.

4. The mounting curb set forth in claim 3 including:
a second set of air flow directing louvers disposed in each of said first ducts between said first openings in said top wall means and said first opening in said bottom wall means for guiding air flow from a horizontal direction to a vertical direction within said first ducts, respectively.

5. The mounting curb set forth in claim 1 wherein:
said first and second sets of ducts in said curb each include portions extending in opposite directions from said respective first and second openings in said bottom wall means to respective ones of said first and second openings in said top wall means.

6. The mounting curb set forth in claim 5 including:
first and second sets of air flow directing louvers in said first ducts for guiding air flowing through said first ducts from a vertical direction to a horizontal direction and from a horizontal direction to a vertical direction, respectively, between said first openings in said top wall means and said first opening in said bottom wall means; and a curved interior sidewall of a portion of each of said first ducts in said curb for guiding air flow between said first and second sets of louvers.

7. The mounting curb set forth in claim 6 wherein:
each of said first ducts includes a flow splitter wall extending between said first and second sets of louvers.

8. The mounting curb set forth in claim 6 wherein:
said curb is formed in at least two sections adapted to be joined together along means forming opposed transverse surfaces between said end walls, said surfaces being formed by opposed flanges on each of said sections.

9. The curb set forth in claim 5 wherein:
at least one of said first ducts includes a backdraft damper interposed therein and operable to prevent flow of air from said first opening in said bottom wall means to one of said first openings in said top wall means.

10. The curb set forth in claim 9 wherein:
each of said first ducts includes a backdraft damper therein and adapted to prevent air flowing through one of said first ducts from its said first opening in said top wall means to said first opening in said bottom wall means and into the other of said first ducts and out of the first opening in said top wall means associated with said other of said first ducts.

11. The curb set forth in claim 10 wherein:
said first ducts are separated by vertical wall means, said backdraft dampers being disposed on opposite sides of said vertical wall means, respectively.

12. The mounting curb set forth in claim 1 includes:
resilient isolator means associated with said frame for supporting said curb on a substructure, and means interposed between said openings in said top wall means and said openings in said bottom wall means forming a flexible portion of each of said first and second ducts for reducing the transmission of mechanical vibrations to said substructure from said air conditioning units.

13. The mounting curb set forth in claim 12 wherein:
said frame includes a member secured to opposed ones of said sidewalls and adapted to be supported on said isolator means, a perimeter member disposed around said sidewalls and said end walls and extending between said bottom wall and a flange of said frame and forming an outer wall surrounding said flexible portion of said ducts.

14. The mounting curb set forth in claim 13 wherein:
said perimeter member comprises a flexible insulation wall extending between said flange and said bottom wall.

15. The mounting curb set forth in claim 14 wherein:
said flange is formed on a lower portion of said sidewalls and said end walls and above said means forming said flexible portion of said first and second ducts.

16. A mounting curb for supporting at least two self contained air conditioning units adapted for roof top installation, said air conditioning units each including an enclosure having a bottom wall including a first opening for receiving return air from a building return air duct and a second opening for discharging conditioned air to a building supply air duct, said mounting curb being characterized by:

a rectangular perimeter frame including spaced apart longitudinal sidewalls and opposed end walls;

means on said frame for supporting each of said enclosure spaced apart on said frame;

spaced apart generally horizontal top wall means and bottom wall means of said frame joined to said side walls and said end walls, respectively;

a set of spaced apart first openings in said top wall means adapted to be aligned with respective ones of said first openings in said enclosures;

a set of spaced apart second openings in said top wall means adapted to be aligned with respective ones of said second openings in said enclosures;

first and second openings formed in said bottom wall means adjacent to each other generally centrally disposed between said endwalls and in communication with said building air ducts, respectively;

a first set of opposed ducts formed in said curb for conducting air between said first openings in said top wall means and said first opening in said bottom wall means, respectively;

a second set of opposed ducts formed in said curb for conducting air between said second openings in said top wall means and said second opening in said bottom wall means, respectively;

respective horizontal and vertical wall means in said curb each forming common walls separating said first set of ducts and said second set of ducts for directing air between said air conditioning units and said building air ducts within said frame; and said curb is formed in two sections of said frame joined together along means forming opposed transverse flanges formed on said sections, respectively, and intersecting said first and second openings in said bottom wall means.

17. A mounting curb for supporting at least two self contained air conditioning units adapted for roof top installation, said air conditioning units each including an enclosure having a bottom wall including a first opening for receiving return air from a building return air duct and a second opening for discharging conditioned air to a building supply air duct, said mounting curb being characterized by:

a rectangular perimeter frame including spaced apart longitudinal sidewalls and opposed end walls;

means on said frame for supporting each of said enclosures spaced apart on said frame;

spaced apart generally horizontal top wall means and bottom wall means of said frame joined to said side walls and end walls, respectively;

a set of spaced apart first openings in said top wall means adapted to be aligned with respective ones of said first openings in said enclosures;

a set of spaced apart second openings in said top wall means adapted to be aligned with respective ones of said second openings in said enclosures;

duct means formed within said frame for conducting air between said enclosures and said building ducts, respectively;

resilient isolator means associated with said frame for supporting said curb on a substructure;

means interposed between said top wall means and said bottom wall means and forming a flexible portion of said duct means for reducing the transmission of mechanical vibrations to said substructure from said air conditioning units;

a member on said frame and secured to opposed ones of said sidewalls and adapted to be supported on said isolator means; and a perimeter member comprising a flexible insulation wall disposed around said sidewalls and said end walls and extending between said bottom wall and a flange on said frame and forming an outer wall surrounding said means forming said flexible portion of said duct means.

18. The mounting curb set forth in claim 17 wherein:

said flange is formed on a lower portion of said sidewalls and said end walls and above said means forming said flexible portion of said duct means.

* * * * *